United States Patent [19]

Weston

[11] 4,275,740

[45] Jun. 30, 1981

[54] BRASSIERE FRAME

[75] Inventor: Jerome L. Weston, New York, N.Y.

[73] Assignee: S & S Industries, Inc., New York, N.Y.

[21] Appl. No.: 41,370

[22] Filed: May 22, 1979

[51] Int. Cl.[3] ..... A41C 3/06

[52] U.S. Cl. ..... 128/469

[58] Field of Search ..... 128/469, 476, 471, 470, 128/472, 479, 504

[56] References Cited

U.S. PATENT DOCUMENTS 2,626,395 1/1953 Whitman ..... 128/469

3,312,223 4/1967 Wilson ..... 128/469

FOREIGN PATENT DOCUMENTS 963843 1/1950 France ..... 128/471

*Primary Examiner*—Doris L. Troutman

*Attorney, Agent, or Firm*—Ladas & Parry

[57] ABSTRACT

A brassiere frame including a pair of arcuate wire members which fit in the pocket of a brassiere for framing the lowest circumferential portion of the brassiere cup, the adjacent ends of the arcuate wire members being interconnected by a plastic hinge member.

2 Claims, 3 Drawing Figures

BRASSIERE FRAME

This invention relates to brassiere frames and, in particular, to brassiere frames incorporating two arcuate wire members interconnected at their adjacent ends.

It is known to use a wire frame in the breast pocket of a brassiere for supporting the breast. Such frames generally are formed from wire in an arcuate shape. The end tips of the wire are covered by a plastic cap to protect the wearer and/or and to prevent the sharp ends from wearing through the material of the brassiere pocket. In the frame arrangement utilized generally in the prior art the two arcuate wire members operate independently of one another without interconnection other than by the materials interconnecting the brassiere pocket.

In one proposal (see Prior Art) it was proposed to interconnect the ends of the arcuate wire members by means of a hinge member constructed of brass with the brass portion being rigidly attached to one of the arcuate wire members ends while the adjacent end of the other arcuate wire member is supported in a recess in the brass portion in a manner permitting pivotal movement of the last mentioned arcuate wire member. Such an arrangement proved expensive to manufacture and of limited utility.

The object to the present invention is to overcome the shortcomings of the prior art.

According to the present invention there is provided a brassiere frame comprising two arcuate wire members the adjacent ends of which are rigidly affixed to a plastic hinge member for hinging movement into a closed position in which the arcuate wire members are superimposed one upon the other.

The invention will now be described, by way of example, with reference to the accompanying drawings, in which.

Figure 2:
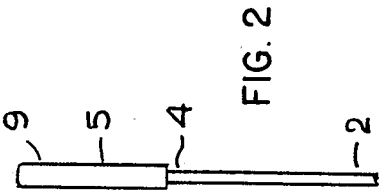
FIG. 2 is an end elevation showing a portion of one arcuate wire member.
Figure 3:
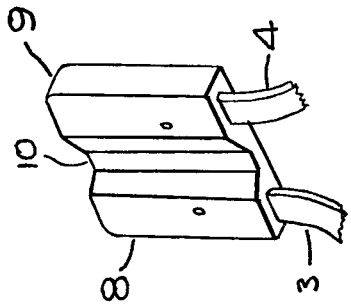
FIG. 3 is a perspective view of a plastic hinge member interconnecting the two arcuate wire members.

With reference to the drawings, the brassiere frame has two arcuate wire members 1 and 2 having adjacent ends 3 and 4 interconnected by a plastic hinge 5. The other ends 6 (one only being shown) of the arcuate members being protected by plastic covers 7 (one only being shown). The plastic covers 7 fit over the ends 6 and are attached to the ends 6 in a manner well known in the prior art.

The plastic hinge 5 comprises wire ends portions 8 and 9 interconnected by the hinge pivot portion 10 which permits hinging of the portions 8 and 9 relative to one another about axis 11. End 3 is located in portion 8 within a passage way formed in the portion 8, the location being by means of a projection on the end 3 in cooperation with an opening 12 extended through the portion 8 transversely of the end 3. End 4 is fixedly attached to and located within portion 9 in a similar manner.

Figure 1:
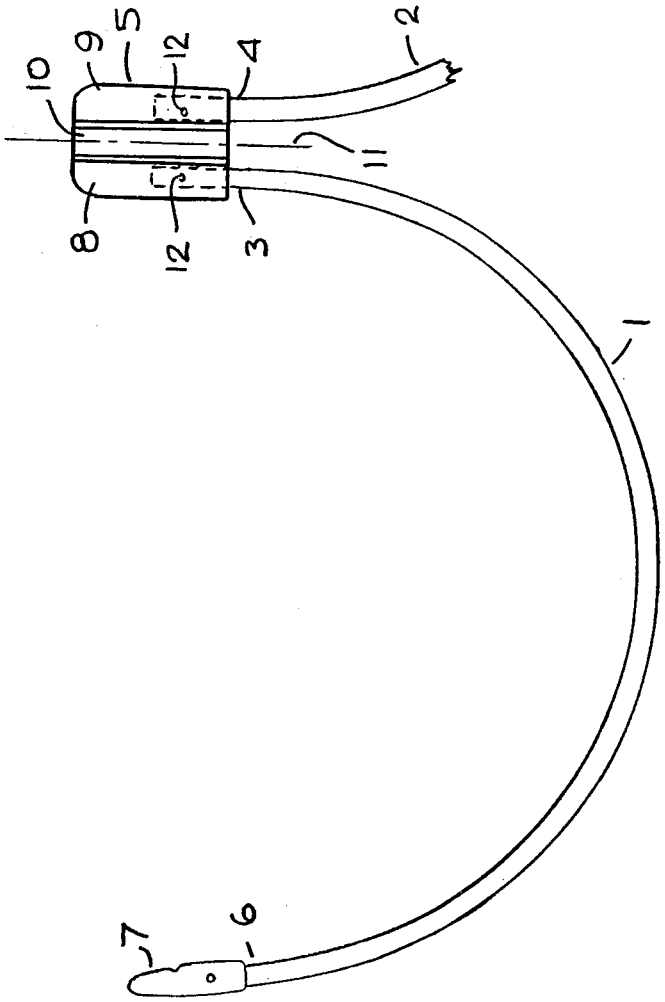
FIG. 1 is a front elevation showing the whole of one arcuate wire member and a portion of a second acurate wire member.

The hinging motion of the hinge 5 about the axis 11 permits the arcuate wire members 1 and 2 to be transported and stored in a closed position, with these members superimposed one upon the other, and be utilized as a brassiere support frame in the open position (FIG. 1) in which the arcuate wire members 1 and 2 are positioned in a fixed location relative to one another, thereby to provide superior support to that possible when separate non-connected wire members are utilized.

It will be appreciated that the arcuate wire members may be of other cross-sections than the rectangular cross-section described herein and that while these wire members are normally constructed of metal; plastic, fiberglass or metal coated with a sheathing may be utilized.

The plastic hinge member may be constructed of any suitable plastic, for example polyurethane. Further, the ends 3 and 4 of the arcuate wire members may be rigidly affixed to the hinge member by other means than that described and shown. For example, the portions 8 and 9 of the hinge member 5 may be formed by molding the hinge member about the ends 3 and 4.

I claim:

1. A brassiere frame to which fabric breast cups are secured comprising two arcuate wire members attached to a central integral hinged plastic member, said plastic member comprising outer holding portions which completely surround and rigidly affix one of the ends of each arcuate wire member, and, interconnecting said holding portions and integral therewith, a hinge portion having a single central pivot axis substantially intermediate said wire ends affixed in said holding portions, whereby hinging movement of said entire brassiere frame occurs permitting said wire members to be substantially superimposed one upon the other.

2. A brassiere frame according to claim 1 wherein said arcuate wire members are flat wires.

* * * * *